US005888416A

United States Patent [19]

Ikuma et al.

[11] Patent Number: 5,888,416

[45] Date of Patent: Mar. 30, 1999

[54] RARE-EARTH BONDED MAGNET COMPOSITION, RARE-EARTH BONDED MAGNET AND PROCESS FOR PRODUCING SAID RARE-EARTH BONDED MAGNET

[75] Inventors: Ken Ikuma; Toshiyuki Ishibashi; Koji Akioka, all of Suwa, Japan

[73] Assignee: Seiko Epson Corporation, Tokyo-To, Japan

[21] Appl. No.: 331,670

[22] PCT Filed: May 11, 1993

[86] PCT No.: PCT/JP93/00611

§ 371 Date: Feb. 13, 1995

§ 102(e) Date: Feb. 13, 1995

[87] PCT Pub. No.: WO93/23858

PCT Pub. Date: Nov. 25, 1993

[30] Foreign Application Priority Data

| | | | |
|---|---|---|---|
| May 12, 1992 | [JP] | Japan | 4-119117 |
| Apr. 12, 1993 | [JP] | Japan | 5-084859 |
| Apr. 15, 1993 | [JP] | Japan | 5-088879 |

[51] Int. Cl.[6] ..... H01F 1/08; H01F 41/02

[52] U.S. Cl. ..... 252/62.54; 252/62.57; 29/607; 335/296; 335/302; 148/100; 148/101; 264/DIG. 61

[58] Field of Search ..... 252/62.54, 62.57; 29/607, 608; 335/296–297, 302; 148/100, 101; 264/DIG. 61

[56] References Cited

U.S. PATENT DOCUMENTS

| | | | |
|---|---|---|---|
| 3,600,748 | 8/1971 | Faehndrich | 425/379.1 |
| 5,376,291 | 12/1994 | Wantanabe | 252/62.54 |
| 5,409,624 | 4/1995 | Watanabe | 252/62.54 |

FOREIGN PATENT DOCUMENTS

| | | |
|---|---|---|
| 0405321 | 1/1991 | European Pat. Off. . |
| 405321 | 1/1991 | European Pat. Off. . |
| 4053211 | 1/1991 | European Pat. Off. . |
| 59-103309 | 6/1984 | Japan . |
| 60-194503 | 10/1985 | Japan . |
| 60-211908 | 10/1985 | Japan . |
| 62-123702 | 6/1987 | Japan . |
| 62-152107 | 7/1987 | Japan . |
| 62-264601 | 11/1987 | Japan . |
| 63-33802 | 2/1988 | Japan . |
| 63-289807 | 11/1988 | Japan . |
| 1-131261 | 5/1989 | Japan . |
| 1-162301 | 6/1989 | Japan . |
| 1-234502 | 9/1989 | Japan . |
| 3-108702 | 5/1991 | Japan . |
| 3-270884 | 12/1991 | Japan . |
| 5-109516 | 4/1993 | Japan . |

OTHER PUBLICATIONS

Patent Abstracts of Japan, vol. 16, No. 403 (E 1254) 26, Aug. 1992 (Seiko Epson KK.).

Patent Abstracts of Japan, vol. 11, No. 4, E–468) 7 Jan. 1987 (Daiseru Hiyurusu KK).

Vieweg et al. Kunststoff–Hanbuch "Polyamide" C.H. Verlag, Munchen De p. 216, paragraph 2, p. 222, paragraph 1. (Date Unknown).

Reference Paper issued by the Magnetics Society of Japan (Issue Date: Oct. 29, 1991).

Journal of the Magnetics Society of Japan (vol. 16, No. 2—1992) (Month Unknown).

*Primary Examiner*—Alan Diamond

*Attorney, Agent, or Firm*—Ladas & Parry

[57] ABSTRACT

The addition of a chelating agent or a chelating agent and an antioxidant in combination to a rare-earth bonded magnet composition and a rare-earth bonded magnet comprising a rare-earth magnetic powder and a resin component can provide improved moldability and magnets having high performance and high corrosion resistance. Further, the regulation of property values of the magnet composition enables the occurrence of troubles to be avoided during molding, resulting in improved productivity. Furthermore, the use of at least two resins as a resin component in an extruding composition contributes to improvement in moldability and consequently increase in throughput. Furthermore, the use of extrusion, involving setting by cooling, and not compression molding in the production of magnets can provide high-density, high-performance magnets.

12 Claims, 1 Drawing Sheet

RARE-EARTH BONDED MAGNET COMPOSITION, RARE-EARTH BONDED MAGNET AND PROCESS FOR PRODUCING SAID RARE-EARTH BONDED MAGNET

This application is a 371 of PCT/JP93/00611 filed May 11, 1993.

TECHNICAL FIELD

The present invention relates to a rare-earth bonded magnet comprising a rare-earth magnetic powder and a resin component, and more particularly to a rare-earth bonded magnet having a high volume fraction of magnetic powder and thus having high performance, a rare-earth bonded magnet composition for use in the production of the rare-earth bonded magnet and a process for producing the rare-earth bonded magnet.

BACKGROUND ART

Rare-earth bonded magnets hitherto been produced by the following methods.

1. Compression molding
2. Injection molding
3. Extrusion molding

Compression molding is generally a method wherein a magnet composition comprising a magnetic powder and a thermosetting resin is filled into a mold in a press at room temperature, compressed the composition and heated to cure the resin, thereby molding a magnet. In the case of the compression molding method, since the resin content of the magnet composition is lower than that for the other molding methods, the freedom of shape in molding a magnet is smaller although the magnetic properties of the resultant magnet are superior.

Injection molding is a method wherein a magnet composition comprising a magnet power and a resin component is heat-melted to prepare a melt having sufficient fluidity which is then injected into a mold where the melt is molded into a desired shape. In the case of the injection molding, in order to impart sufficient fluidity to the magnet composition, the resin content of the magnet composition is higher than that for the compression molding, resulting in lowered magnetic properties. The freedom in molding, however, is higher than that for the compression molding.

Extrusion molding is a method wherein a magnet composition comprising a magnet powder and a resin component is heat-melted to prepare a melt having sufficient fluidity which is then formed into a shape in a die and set by cooling, thereby providing a product having a desired shape. In the extrusion, like the injection molding, the resin content needs to be high enough to impart the magnet composition to fluidity. This method has an advantage that a thin-walled and long magnet can be easily produced.

Among the above methods, injection molding and extrusion generally use a thermoplastic resin as the resin. These are disclosed in Japanese Patent Laid-Open Nos. 123702/1987, 152107/1987, 194503/1985 and 211908/1985.

However, the conventional rare-earth bonded magnet composition comprising a-rare-earth magnet powder and a thermoplastic resin, used in the prior art methods, particularly in injection molding and extrusion, has the following problems. Specifically, since the rare-earth magnet powder comprises a transition metal element, such as Fe or Co, when it is mixed and kneaded with a thermoplastic resin to prepare a composition which is then molded, the transition metal element catalytically acts on the resin component and causes an increase in molecular weight of the resin component, which results in a change in properties of the composition, such as an increase in melt viscosity. This suggests a lowering in heat stability of the rare-earth bonded magnet composition. The above phenomenon is partly described in "Journal of The Magnetics Society of Japan, vol. 16, No. 2, 135–138 (1992)," indicating that a composition comprising an Nd-Fe-B-based magnet powder and a polyamide resin, due to the influence of temperature and shearstress, undergoes changes in properties, particularly viscosity. The higher the content of the rare-earth magnet powder in the composition and the larger the specific surface area of the rare-earth magnetic powder, the higher the above tendency. The above phenomenon raises problems including that the phenomenon makes it impossible to produce a rare-earth bonded magnet composition; even though a rare-earth bonded magnet composition could be successfully produced, it cannot be stably molded due to the deterioration during molding; and it is difficult to improve the magnetic properties of the molded magnet.

For the rare-earth bonded magnet composition, the relationship between the properties of the composition and the moldability has not been fully-clarified particularly in the case of extrusion. Japanese Patent Laid-Open No. 162301/1989 discloses a method wherein the viscosity of a molding composition is specified. In this method, however, the viscosity is specified in relation to the magnetic field for alignment. Further, the resin used is a thermosetting resin, and there is no clear description on the properties, involved in the moldability, of a magnet composition using a thermoplastic resin. Furthermore, no particular attention is paid to a change in properties of the composition during moldings In actual molding, a change in properties derived from the phenomenon, as described above, occurs in the course of feed of the composition into a mold of the molding machine, which makes it impossible to conduct molding. In the case of injection molding, a sprue and a runner are generated due to the nature of the molding method and should be recycled. The change in properties of the composition renders the recycling difficult, unfavorably increasing the loss of material. This incurs an increase in cost of the rare-earth bonded magnet. In the case of the extrusion, unlike the injection molding, there is little or no need of recycling. Since, however, the operation is carried out in a continuous manner, staying of the composition in an extruder or a die often renders the molding impossible. Further, the deterioration of the composition causes a load to be applied to the machine, which often results in failure of the machine and damage to a screw and a die and a nozzle and the like of the injection molding machine.

For the magnet composition used in the extrusion, Japanese Patent Laid-Open No. 264601/1987 discloses the addition of a lubricant, Japanese Patent Laid-Open Nos. 289807/1988 and 162301/1989 disclose a magnet composition using a thermoplastic resin, and Japanese Patent Application No. 270884/1991 discloses a magnet composition having a specified viscosity. As described above, in the case of the conventional magnet composition for extrusion, the properties in a molten state and additives, such as a lubricant, are taken into consideration. However, no satisfactory consideration is given to a resin component particularly when a thermoplastic resin is used as the resin component. In the production of a rare-earth-resin bonded magnet by extrusion, in order to enhance the magnetic properties of the molded magnet, a very large amount of a magnetic powder is incorporated into the magnet composition, resulting in lowered strength, i.e., melt strength, of the magnet composition in a molten state. Therefore, in the case of the extrusion of the above composition, unlike the extrusion of a general resin, it is impossible to adopt a method wherein a resin is formed into a shape in a die which is then taken off to the outside of the die by means of a take-off device, cooled and sized outside the die to provide a final shape. For this reason, in the extrusion of a magnet composition, it is necessary to adopt a method wherein the composition is formed into a final shape in a die which, as such, is set by cooling at the forward end of the die and extruded to the outside of the die. In this method, the magnet composition, which has been set by cooling at the forward end of the die (hereinafter referred to as "cooling section"), should be extruded. This raises a problem that, when only one resin, particularly a crystalline resin, is used in the magnetic composition, the change from a molten state to a solid state is so rapid that the extrusion cannot be carried out, or the extrusion rate (molding rate) is limited by properties of the resin at a temperature around the melting point thereof.

Further, as described above, the rare-earth magnetic powder is highly active enough to deteriorate the resin component during molding, causing the resultant magnet molding to rust by oxidation when it is allowed to stand.

Among the above three methods for producing a rare-earth bonded magnet, the compression molding can produce magnets having the highest performance. Since, however, a thermosetting resin is employed as the resin, the step of heat-curing the resin must be additionally provided in the molding, so that the properties of the resin at the time of heat setting should be taken into consideration. For this reason, the resin cannot be selected based on the moldability alone, and consequently the kind and amount of the resin and the molding conditions cannot be determined from the viewpoint of the moldability alone. Furthermore, since the resin used is a thermosetting resin, defective molded body cannot be recycled.

Accordingly, the present invention provides a solution to the above problems, and an object of the present invention is to provide a high-performance rare-earth bonded magnet with high productivity. Another object of the present invention is to provide rare-earth bonded magnets having various shapes according to the applications thereof.

DISCLOSURE OF THE INVENTION

The rare-earth bonded magnet composition according to the present invention comprises a rare-earth magnet powder and a thermoplastic resin and further comprising 0.1 to 2.0 wt % of a chelating agent. The rare-earth bonded magnet composition may contain 0.1 to 2.0 wt % of a chelating agent having a phenol structure. Further, the rare-earth bonded magnet composition may contain at least one antioxidant and the chelating agent in a total amount of 0.1 to 2 wt % based on the whole composition. Further, the present invention provides a rare-earth bonded magnet composition comprising a rare-earth magnetic powder and a thermoplastic resin, characterized by further comprising at least one antioxidant and a chelating agent having a phenol structure in a total amount of 0.1 to 2 wt % based on the whole composition. These ensure heat stability of the rare-earth bonded magnet composition during kneading and molding, thereby enabling the composition to be stably molded. Further, they enable the volume percent of the magnet powder in the magnet composition to be increased, improving the performance of the molded magnet. Furthermore, they inactivate the rare-earth magnetic powder and, hence, improve the corrosion resistance of the molded magnet.

According to the present invention, in a rare-earth bonded magnet composition comprising a rare-earth magnet powder and a polyamide resin, a chelating agent having an amide group may be added thereto in an amount of 0.1 to 2 wt %. Further, at least one antioxidant and a chelating agent having an amide group may be added in a total amount of 0.1 to 2 wt % to the rare-earth bonded magnet composition. These can ensure heat stability and moldability of the magnet composition particularly when a polyamide resin is used as the resin component.

Further, the present invention provides rare-earth bonded magnet composition for extrusion, comprising a rare-earth magnet powder and a thermoplastic resin (containing an additive), said composition having a viscosity $\eta 1$, as measured in a molten state before charging into an extruder, of 5 kpoise $\leqq \eta 1 \leqq$ 500 kpoise (shear rate: 25 $sec^{-1}$) and a viscosity $\eta 2$, as measured upon delivery from the extruder, satisfying a requirement represented by the following formula $$0.3 \leqq \eta 2/\eta 1 \leqq 10.$$

Furthermore, the present invention provides an injection-molded rare-earth bonded magnet composition, comprising a rare-earth magnet powder and a thermoplastic resin (containing an additive), said composition having a viscosity $\eta 3$, as measured in a molten state before charging into an injection molding machine, of 1 kpoise $\leqq \eta 3 \leqq$ 100 kpoise (shear rate: 1000 $sec^{-1}$) and a viscosity $\eta 4$, as measured upon delivery from the molding machine, satisfying a requirement represented by the following formula $$0.3 \leqq \eta 4/\eta 3 \leqq 5.$$

These reduce the occurrence of machine troubles and the like at the time of extrusion or injection molding, enabling magnets to be produced stably. The rare earth bonded magnet composition may contain an antioxidant, such as a hydrazine antioxidant.

Furthermore, the present invention provides a magnet composition for extrusion, comprising a rare-earth magnet powder and a resin component (containing an inorganic additive), said resin component comprising at least two thermoplastic resins having different melting points. The resin component may comprises at least two thermoplastic resins having different melting points, said resins having a melting point of 120° C. or above with the difference in melting point between said resins being not more than 50° C. Further, the resin component may comprise at least two thermoplastic resins having different melting points, the average molecular weight of the resins except for the resin having the lowest average molecular weight being not more than 5 times the average molecular weight of the resin having the lowest average molecular weight. These facilitate molding of the composition into a magnet and, at the same time, can increase the productivity.

Furthermore, the present invention provides a process for producing a rare-earth bonded magnet, comprising the steps of: preparing a magnet composition for extruding, comprising a rare-earth magnetic powder and at least two kinds of thermoplastic resins (containing an inorganic additive) having different melting points; and molding said composition into a magnet by extrusion wherein said composition is set by cooling in a die. Further, the present invention provides a process for producing a rare-earth-resin bonded magnet, wherein a magnet composition for extrusion is used which comprises a rare-earth magnet powder and a resin component, the resin component comprising at least two thermoplastic resins having different melting points, the resins having a melting point of 120° C. or above with the difference in melting point between said resins being not more than 50° C. These enable high-performance magnets to be produced with high productivity by extrusion.

Further, according to the present invention, in a process for producing a rare-earth bonded magnet comprising a rare-earth magnet powder and a resin component, compression molding in a melting temperature range of the resin component can provide high-density, high-performance rare-earth bonded magnets.

BEST MODE FOR CARRYING OUT THE INVENTION

Figure 1:
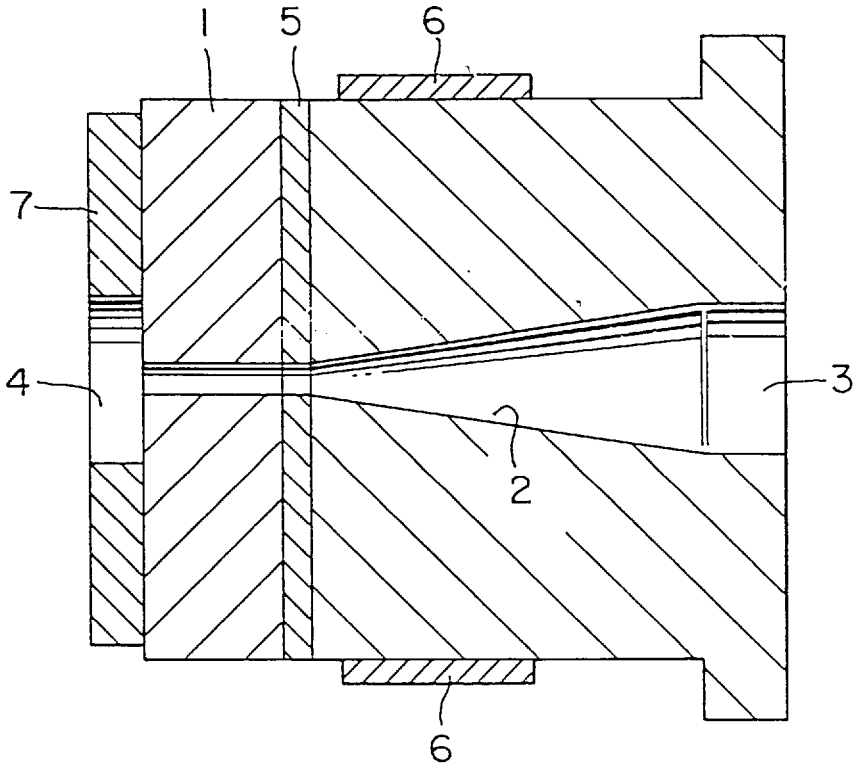
FIG. 1 is a cross-sectional view of a die structure for extrusion molding used in examples of the present invention.

The present invention will now be described with reference to the following examples.

Compounding behavior of ingredients observed during the mixing and kneading of each magnetic powder and a thermoplastic resin alone will now be described as Example 1.

An experiment was carried out as follows. Each magnetic powder specified in Table 1 and a polyamide resin (nylon 12) were weighed so that the volume fraction of the magnetic powder was 75%. They were then mixed together in a V mixer. 45 g of the mixture was placed in a roller mixer (R-60) mounted on Labo Plastomill (manufactured by Toyo Seiki Seisaku Sho, Ltd.) and milled at a temperature of 230° C. and a screw speed of 10 rpm, and the milling torque was measured during the milling operation. The results are given in Table 1.

TABLE 1

| Composition | Magnetic powder | Time A needed for causing increase in torque (min) |
|---|---|---|
| Composition 1 | Sr ferrite powder | >60 |
| Composition 2 | Ba ferrite powder | >60 |
| Composition 3 | $SmCo_5$-based powder | 12 |
| Composition 4 | $Sm_2Co_{17}$-based powder | 14 |
| Composition 5 | $Nd_2Fe_{14}B$-based powder | 9 |
| Composition 6 | $Sm_2Fe_{17}N3$-based powder | 14 |

In the table, the time A needed for causing increase in torque is a milling time taken for the torque value to become at least three times the torque value one minute after the initiation of milling.

As is apparent from the results given in the table, for all the compositions using rare-earth magnetic powder, the time A taken for causing increase in torque was different from and shorter than the compositions using ferritic magnet powders. Both types of compositions exhibited different behaviors also in the change of torque with time. Specifically, for the compositions using ferrite magnetic powders, the torque value was high one minute after the initiation of milling and gradually increased with time but did not become not less than three times the torque value one minute after the initiation of milling. By contrast, the compositions using rare-earth magnet powder exhibited a rapid increase in torque value. The reason for this is considered to reside in that the rare-earth magnet powder has a higher activity than the ferrite magnetic powder and this higher activity leads to an increase in torque, that is, the deterioration of the resin composition.

This is true of, besides the polyamide resin as the resin component, thermoplastic resins, such as PPS (polyphenylene sulfide) and a liquid crystalline polymer, PEN (polyethernitrile).

The above results show that, unlike the ferrite magnetic powder, the rare-earth magnet powder makes it difficult to ensure the stability of the resultant composition.

Then, studies on a method for preventing the deterioration of the composition as described above were carried out as Example 2. The results were as follows.

An Nd-Fe-B-based quenched magnet powder (MQP-B manufactured by GM), a polyamide resin and various chelating agents specified in Table 2 were mixed together so that the amount of the magnetic powder and the chelating agent added were 70 vol % and 1.0 wt %, respectively. 45 g of the mixture was placed in a roller mixer (R-60) mounted on Labo Plastomill (manufactured by Toyo Seiki Seisaku Sho, Ltd.) and milled at a temperature of 230° C. and a screw speed of 10 rpm, and the milling torque was measured during milling. The results are given in Table 3.

TABLE 2

| Chelating agent | Component |
|---|---|
| 1 | Isopropylmalonic acid |
| 2 | Phtalic acid |
| 3 | Diethyltriamine |
| 4 | Phenanthroline |
| 5 | Glutamic acid |
| 6 | Glycine |
| 7 | Phenothiazine |
| 8 | N-Salicyloyl-N'-aldehydehydrazine |
| 9 | N-Salicyloyl-N'-acetylhydrazine |
| 10 | N,N-bis[3-(3,5-di-t-butyl-4-hydroxyphenyl)] propionylhydrazine |
| 11 | N,N-Diphenyloxamide |
| 12 | N,N-Hexamethylenebis(3,5-t-butyl-4-hydroxy-hydrocinnamide) |

In the table3, the time B taken for causing increase in torque is a milling time taken for the torque value to become at least 1.5 times the torque value one minute after the initiation of milling when the change of the milling torque during milling in Labo Plastomill was measured with time. The longer the time B, the better the heat stability of the composition and thus the better the moldability. The measurement was made for 60 minutes for each sample, and when no increase in torque was observed for this period, the time B was indicated as >60.

In the table, composition 19 is a comparative composition not containing a chelating agent and, also for this sample, the time B needed for causing increase in torque was measured.

TABLE 3

| Composition | Chelating agent | Time B needed for causing increase in torque (min) |
|---|---|---|
| Composition 7 | 1 | 22 |
| Composition 8 | 2 | 23 |
| Composition 9 | 3 | 30 |
| Composition 10 | 4 | 26 |
| Composition 11 | 5 | 27 |
| Composition 12 | 6 | 24 |
| Composition 13 | 7 | 29 |
| Composition 14 | 8 | 54 |
| Composition 15 | 9 | 57 |
| Composition 16 | 10 | >60 |
| Composition 17 | 11 | 48 |
| Composition 18 | 12 | 51 |
| Composition 19 | — | 7 |

As is apparent from Table 3, for all the compositions containing chelating agents, the time taken for causing increase in torque was longer than that for the composition not containing any chelating agent. This shows that the addition of a chelating agent contributes to an improvement in stability of the magnet composition at elevated temperature, although the effect varied depending upon the chelating agents, which results in improved throughput in the milling and molding. Further, it is apparent that the chelating agents 8 to 10 and 12 having a phenol structure are more effective and hence more useful than the other chelating agents. This is probably because the phenol structure has the effect of preventing the deterioration of the resin caused by oxidation.

The influence that the amounts of the chelating agents added, which had been found to be effective against the deterioration of the compositions during milling in Example 2, have on the deterioration preventive effect was examined. The results were as follows.

An Nd-Fe-B-based quenched magnet powder (MQP-B manufactured by GM), which had been regulated so as to have a particle size distribution having an average particle diameter of 20 $\mu$m, a polyamide resin and various chelating agents specified in Table 2 were mixed together so that the amount of the magnetic powder was 72.5 vol % with the amount of the chelating agent added being as specified in Table 4. 45 g of the mixture was placed in a roller mixer (R-60) mounted on Labo Plastomill (manufactured by Toyo Seiki Seisaku Sho, Ltd.) and milled at a temperature of 230° C. and a screw speed of 10 rpm, and the milling torque was measured during the milling operation. The results are given in Table 4.

TABLE 4

| Composition | Chelating agent | Amount added (wt %) | Time B taken for causing increase in torque (min) | Crushing strength (kg) |
|---|---|---|---|---|
| Composition 20 | 7 | 0.05 | 9 | — |
| Composition 21 | 7 | 0.1 | 21 | 7.2 |
| Composition 22 | 7 | 1.0 | 34 | 7.6 |
| Composition 23 | 7 | 2.0 | 36 | 7.0 |
| Composition 24 | 7 | 2.3 | 36 | 5.4 |
| Composition 25 | 9 | 0.07 | 11 | — |
| Composition 26 | 9 | 0.2 | 31 | 6.6 |
| Composition 27 | 9 | 1.2 | 48 | 6.7 |
| Composition 28 | 9 | 1.8 | 50 | 7.2 |
| Composition 29 | 9 | 2.5 | 46 | 4.6 |
| Composition 30 | 10 | 0.03 | 15 | — |
| Composition 31 | 10 | 0.1 | 38 | 6.9 |
| Composition 32 | 10 | 0.5 | 55 | 7.0 |
| Composition 33 | 10 | 1.0 | >60 | 6.8 |
| Composition 34 | 10 | 2.0 | >60 | 6.7 |
| Composition 35 | 10 | 2.6 | >60 | 4.9 |

In the table, the crushing strength was determined by weighing the ingredients according to the same formulations as those of the respective compositions, mixing the ingredients together, kneading the mixture in a twin-screw kneading machine to prepare a composition, injection-molding the composition into a ring magnet having an outer diameter of 18 mm, an inner diameter of 16 mm and a height of 10 mm and measuring a load necessary for crushing the ring magnet with a compression strength tester. The results are given in the table.

As is apparent from Table 4, when the amount of the chelating agent added was less than 0.1 wt %, although some effect was attained for improvement in the time for causing increase in torque, the time taken for causing increase in torque was still short, suggesting unsatisfactory heat stability of the composition. Due to the unsatisfactory heat stability, the composition with the amount of the chelating agent added being less than 0.1 wt % could not be successfully molded, rendering the crushing strength of the molded body immeasurable. By contrast, all the compositions containing 0.1 wt % or more of the chelating agent exhibited prolonged time for causing increase in torque and could be successfully molded, thus enabling the crushing strength to be measured. However, all the molded bodies obtained from compositions containing 2.0 wt % or more of the chelating agent had lowered crushing strength. This lowered mechanical strength is considered attributable to a relative lowering in resin content with increasing the amount of the chelating agent added. For this reason, 2.0 wt % is considered appropriate as the upper limit of the amount of the chelating agent added.

Then, the compositions 22, 27 and 33, which had been used for the preparation of samples for the measurement of the crushing strength, was placed in a 10 mm ϕ mold, heated to 230° C. and warm-molded at a molding pressure of 3 tons/cm$^2$ into a cylindrical magnet having an outer diameter of 10 mm and a length of 10 mm. This magnet sample was used to measure the magnetic properties. The results are given in Table 5.

TABLE 5

| Magnet | Composition | Br (kG) | iHc (kOe) | (BH) max | ρ (g/cm$^3$) |
|---|---|---|---|---|---|
| Magnet 1 | Composition 22 | 6.50 | 9.59 | 8.4 | 5.76 |
| Magnet 2 | Composition 27 | 6.49 | 9.58 | 8.4 | 5.75 |
| Magnet 3 | Composition 33 | 6.51 | 9.58 | 8.3 | 5.75 |

As is apparent from Table 5, the use of compositions having good heat stability has enabled magnets having high magnetic properties to be produced. The magnets provided in Table 5 have a theoretical density of 5.8 g/cm$^3$, indicating that high-density molded body substantially free from vacancy could be obtained by warm molding.

Then, the effect of adding of a chelating agent and an antioxidant in combination will now be described as Example 3.

An Nd-Fe-B-based quenched magnet powder (MQP-B manufactured by GM), which had been regulated so as to have a particle size distribution having an average particle diameter of 20 $\mu$m, a polyamide resin, various chelating agents specified in Table 2 and antioxidants specified in Table 6 were mixed together so that the amount of the magnetic powder was 75.0 vol % and the total amount of the chelating agent and the antioxidant added was 1.0 wt % with the amount of the chelating agent being equal to that of the antioxidant.

TABLE 6

| Antioxidant | Component |
|---|---|
| A | 4,4'-Butylidene-bis(3-methyl-6-t-butylphenol) |
| B | 1,3,5-Trimethyl-2,4,6-tris(3,5-di-t-butyl-4-hydroxybenzyl)benzene |
| C | |
| D | N,N'-Hexamethylene-bis(3,5-t-butyl-4-hydroxy-hydrocinnamide) |
| E | Phenyl-β-naphthylamine |

45 g of the mixture was placed in a roller mixer (R-60) mounted on Labo Plastomill (manufactured by Toyo Seiki Seisaku Sho, Ltd.) and milled at a temperature of 230° C. and a screw speed of 10 rpm, and the milling torque was measured during milling. The results are given in Table 7.

TABLE 7

| Composition | Chelating agent | Anti-oxidant | Time B taken for causing increase in torque (min) |
|---|---|---|---|
| Composition 36 | 7 | — | 14 |
| Composition 37 | 7 | A | 35 |
| Composition 38 | 7 | B | 36 |
| Composition 39 | 7 | C | 37 |
| Composition 40 | 7 | D | 55 |
| Composition 41 | 7 | E | 32 |
| Composition 42 | 9 | — | 19 |
| Composition 43 | 9 | A | 42 |
| Composition 44 | 9 | B | 48 |
| Composition 45 | 9 | C | 47 |
| Composition 46 | 9 | D | 50 |
| Composition 47 | 9 | E | >60 |
| Composition 48 | 10 | — | 42 |
| Composition 49 | 10 | A | >60 |
| Composition 50 | 10 | B | >60 |
| Composition 51 | 10 | C | >60 |
| Composition 52 | 10 | D | >60 |
| Composition 53 | 10 | E | >60 |

The antioxidant D listed in Table 6 is an antioxidant having a chelate structure. In Table 1, for compositions wherein no antioxidant is indicated the experiment was carried out by adding 1.0 wt % chelating agent without adding any antioxidant, and the results are given in Table 7.

As is apparent from Table 7, all the compositions containing a chelating agent and an antioxidant in combination exhibited prolonged time taken for causing increase in torque, indicating improved heat stability of the compositions. This is considered attributable to the fact that the antioxidant can prevent a chain reaction associated with the deterioration of the resin caused by uneven distribution of the chelating agent, thereby further improving the stability of the composition. Further, the addition of a chelating agent having a phenol structure as the antioxidant results in better anti-oxidizing effect. The above results demonstrate that the addition of a chelating agent (including those having a phenol structure) and an antioxidant in combination can improve the heat stability of the composition, resulting in improved moldability.

The addition of a chelating agent and an antioxidant in varied amounts will now be described as Example 4.

An Nd-Fe-B-based quenched magnetic powder (MQP-B manufactured by GM), which had been regulated so as to have a particle size distribution having an average particle diameter of 20 $\mu$m, a polyamide resin, a chelating agent specified in Table 2 and an antioxidant specified in Table 6 were mixed together so that the amount of the magnetic powder was 78.0 vol % and the total amount of the chelating agent and the antioxidant added were as indicated in Table 8 with the amount of the chelating agent being equal to that of the antioxidant. 45 g of the mixture was placed in a roller mixer (R-60) mounted on Labo Plastomill (manufactured by Toyo Seiki Seisaku Sho, Ltd.) and milled at a temperature of 230° C. and a screw speed of 10 rpm, and the milling torque was measured during the milling operation. The results are given in Table 8.

In the table, the crushing strength was determined by weighing the ingredients according to the same formulations as those of the respective compositions, mixing the ingredients together, kneading the mixture in a twin-screw kneading machine to prepare a magnet composition and extruding the composition by the following method.

The resultant magnet composition is placed in a single-screw extruder where it is melted. The melt is poured under pressure into a die as shown in FIG. 1 where it is formed into a desired shape which is then cooled at the forward end portion of the die (cooling zone) 1 to solidify the melt. The solid matter is then extruded to the outside of the die. FIG. 1 is a schematic cross-sectional view of a die structure which is used for molding of a magnet in a sheet, tile or block shape. In the drawing, numeral 1 designates a cooling zone, numeral 2 a passage for a magnet composition, numeral 3 an inlet of a die passage, numeral 4 an outlet of a die passage, numeral 5 an insulating material, numeral 6 a heater, and numeral 7 a cooling fixture. When the magnet composition is molded into a pipe, a mandrel is provided within the passage 2 located at the center portion of the die. When an anisotropic magnetic powder is used, if necessary, a soft magnetic material is used in the cooling zone and a magnetic circuit is provided in the cooling zone to generate magnetic flux within the die passage, thereby aligning magnetic fields. The extrudate is cut into a desired shape as a final product.

The magnet prepared by molding had an outer diameter of 18 mm and an inner diameter of 16 mm and was cut into a length of 10 mm to prepare a ring magnet. The load necessary for crushing the ring magnet was measured with a compression strength tester. The results are given in the following table. The "Amount added" indicated in the table is the total amount of the chelating agent and the antioxidant. The composition 69 is a composition containing only a chelating agent as the additive.

TABLE 8

| Composition | Chelating agent | Anti-oxidant | Amount added (wt. %) | Time B taken for causing increase in torque (min) | Crushing strength (Kg) |
|---|---|---|---|---|---|
| Composition 54 | 7 | A | 0.05 | 6 | — |
| Composition 55 | 7 | A | 0.1 | 24 | 8.8 |
| Composition 56 | 7 | A | 1.0 | 31 | 8.6 |
| Composition 57 | 7 | A | 2.0 | 33 | 8.2 |
| Composition 58 | 7 | A | 2.4 | 34 | 6.4 |
| Composition 59 | 9 | D | 0.05 | 7 | — |
| Composition 60 | 9 | D | 0.1 | 37 | 8.6 |
| Composition 61 | 9 | D | 1.0 | 46 | 8.7 |
| Composition 62 | 9 | D | 1.9 | 48 | 8.1 |
| Composition 63 | 9 | D | 2.6 | 46 | 5.6 |
| Composition 64 | 10 | C | 0.05 | 11 | — |
| Composition 65 | 10 | C | 0.1 | 38 | 10.1 |
| Composition 66 | 10 | C | 0.5 | 48 | 9.9 |
| Composition 67 | 10 | C | 2.0 | >60 | 10.0 |
| Composition 68 | 10 | C | 2.3 | >60 | 6.1 |
| Composition 69 | 10 | — | 2.0 | 39 | 7.3 |

As is apparent from Table 8, when the total amount of the chelating agent and the antioxidant added is less than 0.1 wt %, the time for causing increase in torque is short, suggesting poor heat stability of the composition. Due to the poor heat stability, this composition could not be successfully extruded, rendering the crushing strength of the molded body immeasurable. By contrast, all the compositions containing the chelating agent and the antioxidant in a total amount of not less than 0.1 wt % exhibited prolonged time for causing increase in torque, suggesting improved heat stability of the composition. The addition of the chelating agent and the antioxidant in a total amount exceeding 2.0 wt %, however, results in lowered crushing strength. This lowered crushing strength is considered attributable to a relative lowering in resin content with increasing the total amount of the chelating agent and the antioxidant added, which lowers the binding ability of the resin. Further, it is considered attributable also to the fact that some additives unfavorably lower the binding ability of the resin.

From the above results, the amounts of the chelating agent and the antioxidant added are considered to be preferably not less than 0.1 wt % and not more than 2.0 wt %, respectively.

TABLE 9

| Magnet | Composition | Br (kG) | iHc (kOe) | (BH) max | ρ (g/cm$^3$) |
|---|---|---|---|---|---|
| Magnet 4 | Composition 56 | 7.09 | 9.58 | 9.8 | 6.08 |
| Magnet 5 | Composition 61 | 7.10 | 9.60 | 9.9 | 6.09 |
| Magnet 6 | Composition 67 | 7.10 | 9.60 | 10.0 | 6.09 |

For the compositions 56, 61 and 67, the samples prepared for the crushing test were used to measure the magnetic properties. The results are given in Table 9. The magnets prepared above have a theoretical density of 6.12 g/cm$^3$.

As is apparent from Table 9, high-density, high-performance magnets could be prepared by molding compositions having improved stability at elevated temperature.

Further, the above magnets were allowed to stand in a thermo-hygrostat of 60° C.×95% for an anticorrosion test. For comparison, the same test was carried out for a magnet, having the same shape, prepared by the conventional compression molding.

As a result, for the magnet prepared by the conventional compression molding, resting was observed 100 hours after the initiation of the test, whereas the magnets of the present invention did not rust even 500 hours after the initiation of the test. This shows that the presence of a chelating agent in the magnet and the presence of vacancy in a lower proportion in the magnet contribute to improvement in corrosion resistance.

The results of evaluation for the use of various resins in the magnet composition of the present invention will now be described as Example 5.

An Nd-Fe-B-based quenched magnetic powder (MQP-B manufactured by GM), which had been regulated so as to have a particle size distribution having an average particle diameter of 20 μm, a resin specified in Table 7, a chelating agent specified in Table 2 and an antioxidant specified in Table 6 were mixed together so that the amount of the magnetic powder was 75.0 volt and the amount of the chelating agent when added alone or the total amount of the chelating agent and the antioxidant when added in combination was 1.0 wt % with the amounts of the chelating agent and the antioxidant, when added in combination, being equal to each other. 45 g of the mixture was placed in a roller mixer (R-60) mounted on Labo Plastomill (manufactured by Toyo Seiki Seisaku Sho, Ltd.) and milled at a temperature of 280° C. and a screw speed of 10 rpm, and the milling torque was measured during the milling operation. The results are given in Table 10.

TABLE 10

| Composition | Chelating agent | Anti-oxidant | Resin | Time B taken for causing increase in torque (min) |
|---|---|---|---|---|
| Composition 70 | 7 | — | PPS | 35 |
| Composition 71 | 7 | A | PPS | 46 |
| Composition 72 | — | — | PPS | 15 |
| Composition 73 | 7 | — | PEN | 29 |
| Composition 74 | 7 | A | PEN | 38 |
| Composition 75 | — | — | PEN | 12 |
| Composition 76 | 10 | — | Liquid crystalline polymer | 45 |
| Composition 77 | 10 | C | Liquid crystalline polymer | 49 |
| Composition 78 | — | — | Liquid Crystalline polymer | 9 |
| Composition 79 | 10 | — | PA6 | >60 |
| Composition 80 | 10 | C | PA6 | >60 |
| Composition 81 | — | — | PA6 | 8 |

In the above table, PPS, PEN and PA6 respectively represent polyphenylene sulfide, polyethernitrile and polyamide-6-(nylon 6).

As is apparent from the table, for all the compositions containing as the additive a chelating agent alone or a chelating agent and an antioxidant in combination, the time for causing increase in torque was longer than that for the compositions containing as the additive none of the chelating agent and the antioxidant. The above results demonstrate that the addition of a chelating agent alone or in combination with an antioxidant can contribute to an improvement in heat stability although the effect somewhat varies depending upon the resins. Further, when a chelating agent 10 having an amide group was added to a polyamide resin, the resultant composition had better heat stability than the compositions comprising a combination of the chelting resin with the other resins.

The use of an Sm-Co-based magnetic powder as the magnetic powder will now be described as Example 6.

Alloying ingredients were melted so as to give an alloy composition, $Sm(Co_{0.672}Fe_{0.22}Cu_{0.08}Zr_{0.028})8.35$, and the melt was cast into a magnetic alloy. The magnetic alloy was heat-treated and pulverized to prepare an Sm-Co-based magnetic powder having an average particle diameter of about 20 μm. The magnetic powder, a polyamide resin, a chelating resin specified in Table 2 and an antioxidant specified in Table 6 were weighed and mixed together so that the volume percent of the magnetic powder was 80.0% and the amount of the additive was 1.0 wt % with the amounts of the chelating agent and the antioxidant, when added in combination, being equal to each other. 45 g of the mixture was placed in a roller mixer (R-60) mounted on Labo Plastomill (manufactured by Toyo Seiki Seisaku Sho, Ltd.)

and milled at a temperature of 230° C. and a screw speed of 10 rpm, and the milling torque was measured during the milling operation. The results are given in Table 11.

TABLE 11

| Composition | Chelating agent | Anti-oxidant | Time B taken for causing increase in torque |
|---|---|---|---|
| Composition 82 | 7 | — | 37 |
| Composition 83 | 7 | D | >60 |
| Composition 84 | — | — | 9 |
| Composition 85 | 10 | — | >60 |
| Composition 86 | 10 | C | >60 |
| Composition 87 | — | — | 13 |

As is apparent from Table 11, also when an Sm-Co-based magnetic powder was used as the magnetic powder, the magnet compositions with a chelating agent alone or in combination with an antioxidant added thereto had better heat stability than the composition with none of the chelating agent and the antioxidant being added thereto, suggesting that these compositions can be easily molded.

The influence of the volume percent of the magnetic powder will now be described as Example 7.

An Nd-Fe-B-based quenched magnetic powder (MQP-B manufactured by GM), which had been regulated so as to have a particle size distribution having an average particle diameter of 20 $\mu$m, a polyamide resin, a chelating agent specified in Table 2 and an antioxidant specified in Table 6 were mixed together so that the amount of the chelating agent when added alone or the total amount of the chelating agent and the antioxidant when added in combination was 1.0 wt % with the amounts of the chelting agent and the antioxidant, when added in combination, being equal to each other, thereby preparing mixtures having varied volume percent of magnetic powder. The mixtures were placed in a twin-screw extruder, and the resultant compounds were placed in an extruding machine and extruded into a pipe magnet having 18ϕ×16ϕ. At that time, for each formulation, the maximum volume percent of the magnetic powder which permits the composition to be successfully extruded was determined. The results are given in Table 12.

TABLE 12

| Formulation | Chelating agent | Anti-oxidant | Maximum volume percent of magnetic powder (vol %) |
|---|---|---|---|
| Formulation 1 | 7 | — | 75 |
| Formulation 2 | 7 | D | 76 |
| Formulation 3 | 9 | — | 75 |
| Formulation 4 | 9 | C | 77 |
| Formulation 5 | 10 | — | 78 |
| Formulation 6 | 10 | C | 80 |
| Formulation 7 | — | — | 50 |

As is apparent from Table 12, for the formulations not using the additive, the volume percent of the magnetic powder, which permits the composition to be molded, was up to 50%, whereas for all the other formulations, the volume percent of the magnet power, which permits the composition to be molded, was as high as at least 75%, suggesting that these compositions can be molded into high-performance magnets.

Then, for the formulations 5, 6 and 7, the magnetic properties were measured using the maximum volume percent of magnet powder. The results are given in Table 13.

TABLE 13

| Magnet | Formulation | Br (kG) | iHc (kOe) | (BH) max | ρ (g/cm$^3$) |
|---|---|---|---|---|---|
| Magnet 4 | Formulation 5 | 7.10 | 9.58 | 10.0 | 6.11 (0.2) |
| Magnet 5 | Formulation 6 | 7.25 | 9.63 | 10.4 | 6.16 (0.5) |
| Magnet 6 | Formulation 7 | 4.95 | 9.53 | 4.9 | 4.27 (0.4) |

As is apparent from Table 13, the use of the compositions of present invention has enabled high-performance, high-density magnets to be molded.

Further, these magnets were allowed to stand in a thermo-hygrostat of 60° C.×95% for an anticorrosion test. For comparison, the same test was carried out for a magnet, having the same shape, prepared by the conventional compression molding.

As a result, for the magnet prepared by the conventional compression molding, rusting was observed 100 hours after the initiation of the test, whereas the magnets of the present invention did not rust even 500 hours after the initiation of the test. This shows that the presence of a chelating agent in the magnet contribute to improvement in corrosion resistance.

The extrudability and the like of the compositions with the properties being varied by varying the volume percent of the magnetic powder and the amount of the additive were investigated as Example 8. The results were as follows.

An Nd-Fe-B-based quenched magnetic powder (MQP-B manufactured by GM), a polyamide resin, chelating agent 10, antioxidant C and a lubricant were weighed in desired amount ratios and mixed together, and the mixtures was then placed in a twin-screw extruder and kneaded at 230° C. to prepare various compositions. At that time, the volume percent of the magnetic powder was varied to prepare compositions having varied viscosities. These compositions were placed in a single-screw extruder and extruded at 230° to 270° C. to evaluate the moldability. The evaluation of the extrudability was carried out based on whether or not the composition could be successfully extruded into a pipe magnet having an outer diameter of 10 mm and an inner diameter of 8 mm for 10 hours or longer. Viscosity measurements were made with a capillary rheometer before the charge into the extruder and upon delivery from the extruder. The former viscosity was η1, and the latter viscosity was η2. The viscosity was measured under conditions of a temperature of 270° C. and a shear rate of 25 sec$^{-1}$. The results of evaluation are given in Table 14.

TABLE 14

| Composition | Magnet powder (vol %) | η1 (kpoise) | η2/η1 | Extrudability (hr) |
|---|---|---|---|---|
| Composition 88 | 60 | 10 | 0.7 | >10 |
| Composition 89 | 70 | 120 | 0.8 | >10 |
| Composition 90 | 75 | 200 | 0.8 | >10 |

TABLE 14-continued

| Composition | Magnet powder (vol %) | η1 (kpoise) | η2/η1 | Extrudability (hr) |
|---|---|---|---|---|
| Composition 92 | 80 | 380 | 1.0 | >10 |
| Composition 93 | 82 | 450 | 1.5 | >10 |
| Composition 94 | 84 | 530 | 2.0 | Impossible to extrude |

As is apparent from Table 14, when the composition had a viscosity of more than 500 kpoise, it could not extruded. On the other hand, the compositions could be successfully extruded when they had a viscosity of not more than 500 kpoise and a viscosity ratio of not more than 10. From these results, the upper limit of the viscosity at the time of extruding of the composition is 500 kpoise.

TABLE 15

| Magnet | Composition | Br (kG) | iHc (kOe) | (BH) max | ρ (g/cm$^3$) |
|---|---|---|---|---|---|
| Magnet 10 | Composition 92 | 7.24 | 9.58 | 10.3 | 6.15 |
| Magnet 11 | Composition 93 | 7.32 | 9.56 | 10.5 | 6.22 |

The magnetic properties of the extrudates 92 and 93 obtained from the extrudable compositions were measured by VSM. The results are given in Table 15.

As is apparent from Table 15, high-performance magnets could be prepared when the properties of the compositions fell within the scope of the present invention.

Then, in a composition consisting of an R-Fe-B-based magnet powder, a polyamide resin, chelating agent 10, antioxidant C and a lubricant, the amount of the additive was varied to prepare compositions having varied viscosities which were then evaluated. The results are given in Table 2. In this case, the volume percent of the magnetic powder was kept constant at 60%. All the compositions could be molded without any problem.

TABLE 16

| Composition | η1 (kpoise) | η2/η1 | Crushing strength (kg) |
|---|---|---|---|
| Composition 95 | 3 | 0.5 | 3.2 |
| Composition 96 | 4 | 0.5 | 4.1 |
| Composition 97 | 7 | 0.7 | 7.3 |
| Composition 98 | 10 | 0.7 | 10.3 |
| Composition 99 | 20 | 0.7 | 10.2 |

In Table 16, the crushing strength represents strength as measured by cutting, into a size of 10 mm, a ring magnet, having a size of 10ϕ×8ϕ, prepared by the extrusion and crushing the magnet. As is apparent from Table 16, when the viscosity of the compositions is less than 5 kpoise, the extrudates had lowered mechanical strength although no problem of the extrudability arose. From this, the lower limit of the viscosity of the composition for extrusion is 5 kpoise.

Then, in a composition consisting of an Nd-Fe-B-based magnetic powder, nylon 12, chelating agent 10, antioxidant C and a lubricant, the amount of the antioxidant added was varied to prepare compositions having varied ratios of the viscosity η1 before charging into an extruder to the viscosity η2 upon delivery from the extruder. These compositions were evaluated for extrudability and crushing strength. In this case, the volume percent of the magnetic powder was 67%. The results are given in Table 17. The evaluation method was the same as that in Examples 8 and 9.

TABLE 17

| Composition | η1 (kpoise) | η2/η1 | Extrudability (hr) | Crushing strength (kg) |
|---|---|---|---|---|
| Composition 100 | 38 | 0.2 | >10 | 5.0 |
| Composition 101 | 37 | 0.3 | >10 | 7.5 |
| Composition 102 | 36 | 0.7 | >10 | 10.0 |
| Composition 103 | 42 | 1.0 | >10 | 9.8 |
| Composition 104 | 40 | 5.3 | >10 | 10.2 |
| Composition 105 | 40 | 9.0 | >10 | 11.0 |
| Composition 106 | 38 | 11.0 | Impossible to extrude | — |

As is apparent from Table 17, when the viscosity ratio η2/η1 was more than 10, it was difficult to extrude the composition due to the deterioration of the composition. On the other hand, when the viscosity ratio was not more than 10, the compositions could be successfully extruded for 10 hours or more. For this reason, the upper limit of the viscosity ratio is 10 from the viewpoint of extrudability. When the viscosity ratio was less than 0.3, the composition could be stably extruded for 10 hours or longer. In this case, however, the mechanical strength of the extrudate was about half of that of the extrudates from the compositions having a viscosity ratio of not less than 0.3, that is, the mechanical strength of the extrudate was lowered. For this reason, the viscosity ratio should not be less than 0.3 from the viewpoint of ensuring the mechanical strength.

The experiment of Example 8 was repeated as Example 9, except that injection molding was carried out instead of the extrusion.

An Nd-Fe-B-based quenched magnetic powder (MQP-B manufactured by GM), a polyamide resin, chelating agent 10, antioxidant C and a lubricant were weighed in desired amount ratios and mixed together, and the mixtures was then placed in a twin-screw extruder and compounded at 230° C. to prepare various compositions. At that time, the volume percent of the magnetic powder was varied to prepare compositions having varied viscosities. These compositions were placed in an injection molding machine and injection molded at 250° to 300° C. to evaluate the moldability. The moldability was evaluated in terms of recycleability. The magnets prepared by injection molding were in the form of a tile having an outer diameter R of 4.6 mm, an inner diameter r of 3.6 mm, a round angle of 115° and a length of 10 mm. Further, viscosity measurements were made with a capillary rheometer before charging into the molding machine and upon delivery from the injection molding machine. The former viscosity was η3, and the latter viscosity was η4. The viscosity was measured under conditions of a temperature of 250° C. and a shear rate of 1000 sec$^{-1}$. The results of evaluation are given in Table 18.

TABLE 18

| Composition | Magnetic powder (vol %) | η1 (kpoise) | η2/η1 | Recyclability (number of times) |
|---|---|---|---|---|
| Composition 107 | 60 | 7 | 0.7 | >10 |
| Composition 108 | 70 | 20 | 0.8 | >10 |
| Composition 109 | 75 | 70 | 0.9 | >10 |

TABLE 18-continued

| Composition | Magnetic powder (vol %) | η1 (kpoise) | η2/η1 | Recyclability (number of times) |
|---|---|---|---|---|
| Composition 110 | 77 | 95 | 1.0 | >10 |
| Composition 111 | 80 | 130 | 2.0 | Impossible to mold |

As is apparent from Table 18, when the composition had a viscosity of more than 100 kpoise, it could not injection-molded. On the other hand, the compositions could be molded when they had a viscosity of not more than 100 kpoise and a viscosity ratio of not more than 5. This is because when the composition has a viscosity of more than 100 kpoise, the fluidity of the composition becomes so low that the composition cannot be injected into a die.

From these results, the upper limit of the viscosity at the time of injection molding of the composition is 100 kpoise.

TABLE 19

| Magnet | Composition | Br (kG) | iHc (kOe) | (BH) max | ρ (g/cm$^3$) |
|---|---|---|---|---|---|
| Magnet 10 | Composition 109 | 6.92 | 9.70 | 9.0 | 5.88 |
| Magnet 11 | Composition 110 | 7.07 | 9.69 | 9.7 | 6.82 |

Magnetic properties of the extrudates obtained from the moldable compositions 109 and 110 were measured by VSM.

As is apparent from Table 19, high-performance magnets could be prepared when the properties of the compositions fell within the scope of the present invention.

Then, in a composition consisting of an R-Fe-B-based magnetic powder, a polyamide resin, chelating agent 10, antioxidant C and a lubricant, the amount of the additive was varied to prepare compositions having varied viscosities which were then evaluated. The results are given in Table 20. In this case, the volume percent of the magnet powder was kept constant at 60%. All the compositions could be molded without any problem.

TABLE 20

| Composition | η1 (kpoise) | η2/η1 | Crushing strength (kg) |
|---|---|---|---|
| Composition 112 | 0.8 | 0.5 | 5.0 |
| Composition 113 | 1.1 | 0.5 | 7.5 |
| Composition 114 | 2 | 0.6 | 9.8 |
| Composition 115 | 5 | 0.6 | 9.8 |

In Table 20, the crushing strength represents strength as measured by crushing a ring magnet, having a size of 10ϕ×8ϕ×10t, prepared by the injection molding. As is apparent from Table 20, when the viscosity of the composition is less than 1 kpoise, the ring magnet had lowered mechanical strength although no problem of the moldability arose. From this, the lower limit of the viscosity of the composition for injection molding is 1 kpoise.

Then, in a composition consisting of an Nd-Fe-B-based magnetic powder, nylon 12, chelating agent 10, antioxidant C and a lubricant, the amount of the antioxidant added was varied to prepare compositions having varied ratios of the viscosity η3 before charging into the varied ratios of the viscosity η3 before charging into the molding machine to the viscosity η4 upon delivery from the molding machine. These compositions were evaluated for moldability and crushing strength. In this case, the volume percent of the magnetic powder was 70%. The results are given in Table 21. The evaluation method was the same as that in Example 8.

TABLE 21

| Composition | η1 (kpoise) | η2/η1 | Recyclability (number of times) | Crushing strength (kg) |
|---|---|---|---|---|
| Composition 116 | 15 | 0.2 | >10 | 5.2 |
| Composition 117 | 16 | 0.4 | >10 | 8.3 |
| Composition 118 | 17 | 0.7 | >10 | 9.7 |
| Composition 119 | 15 | 1.0 | >10 | 10.5 |
| Composition 120 | 16 | 4.3 | >10 | 10.2 |
| Composition 121 | 15 | 5.2 | Impossible to mold | — |

As is apparent from Table 21, when the viscosity ratio η4/η3 was more than 5, it was difficult to extrude the composition due to the deterioration of the composition in the molding machine. On the other hand, when the viscosity ratio was not more than 5, the compositions could be recycled more than ten times for molding. For this reason, the upper limit of the viscosity ratio is 5 from the viewpoint of moldability. When the viscosity ratio was less than 0.3, the composition could be recycled more than 10 times for molding. In this case, however, the mechanical strength of the molded body was about half of that of the molded bodies from the compositions having a viscosity ratio of not less than 0.3, that is, the mechanical strength of the extrudate was lowered. For this reason, the viscosity ratio should not be less than 0.3 from the viewpoint of ensuring the mechanical strength.

The experiment of Example 9 was repeated as Example 10, except that the magnetic powder and the resin component were varied in order to investigate the influence thereof.

The Sm-Co-based magnet powder and the liquid crystalline polymer used in Example 6, chelating agent 10, antioxidant C and a lubricant were weighed in desired amount ratios and mixed together, and the mixtures was then placed in a twin-screw extruder and kneaded at 280° C. to prepare various compositions. At that time, the volume percent of the magnetic powder was varied to prepare compositions having varied viscosities. These compositions were placed in an injection molding machine and injection-molded at 280° to 300° C. to evaluate the moldability. The moldability was evaluated in terms of recycleability. The magnets prepared by injection molding were in the form of a tile having an outer diameter R of 4.6 mm, an inner diameter r of 3.6 mm, a round angle of 115° and a length of 10 mm. Further, viscosity measurements were made with a capillary rheometer before charging into the molding machine and upon delivery from the injection molding machine. The former viscosity was η3, and the latter viscosity was η4. The viscosity was measured under conditions of a temperature of 320° C. and a shear rate of 1000 sec$^{-1}$. The results of evaluation are given in Table 22.

TABLE 22

| Composition | Magnetic powder (vol %) | η3 (kpoise) | η4/η3 | Recyclability (number of times) |
|---|---|---|---|---|
| Composition 122 | 60 | 6 | 0.6 | >10 |
| Composition 123 | 70 | 21 | 0.6 | >10 |
| Composition 124 | 72 | 80 | 0.7 | >10 |
| Composition 125 | 75 | 90 | 0.8 | >10 |
| Composition 126 | 77 | 130 | 2.0 | Impossible to mold |

As is apparent from Table 22, when the composition had a viscosity of more than 100 kpoise, it could not be injection-molded. On the other hand, the compositions could be molded when they had a viscosity of not more than 100 kpoise and a viscosity ratio of not more than 5. This is because when the composition has a viscosity of more than 100 kpoise, the fluidity of the composition becomes so low that the composition cannot be injected into a die.

From these results, the upper limit of the viscosity at the time of injection molding of the composition is 100 kpoise.

Then, in a composition consisting of an Sm-Co-based magnetic powder, a liquid crystalline polymer, chelating agent 10, antioxidant C and a lubricant, the amount of the additive was varied to prepare compositions having varied viscosities which were then evaluated. The results are given in Table 23. In this case, the volume percent of the magnetic powder was kept constant at 60%. All the compositions could be molded without any problem.

TABLE 23

| Composition | η3 (kpoise) | η4/η3 | Crushing strength (kg) |
|---|---|---|---|
| Composition 127 | 0.7 | 0.5 | 4.8 |
| Composition 128 | 1.0 | 0.5 | 7.2 |
| Composition 129 | 3 | 0.6 | 9.6 |
| Composition 130 | 5 | 0.6 | 9.5 |

In Table 23, the crushing strength represents strength as measured by crushing a ring magnet, having a size of 10ϕ×8ϕ×10t, prepared by the injection molding. As is apparent from Table 23, when the viscosity of the composition is less than 1 kpoise, the ring magnet had lowered mechanical strength although no problem of the moldability arose. From this, the lower limit of the viscosity of the composition for injection molding is 1 kpoise.

Then, in a composition consisting of an Sm-Co-based magnet powder, a liquid crystalline polymer (Vectra (trademark) manufactured by Polyplastics Co., Ltd.), chelating agent 10, antioxidant C and a lubricant, the amount of the additive was varied to prepare compositions having varied ratios of the viscosity η3 before charging into the molding machine to the viscosity η4 upon delivery from the molding machine. These compositions were evaluated for moldability and crushing strength. In this case, the volume percent of the magnetic powder was 70%. The results are given in Table 24. The evaluation method was the same as that in Example 8.

TABLE 24

| Composition | η1 (kpoise) | η2/η1 | Recyclability (number of times) | Crushing strength (kg) |
|---|---|---|---|---|
| Composition 131 | 18 | 0.2 | >10 | 5.6 |
| Composition 132 | 18 | 0.5 | >10 | 8.9 |
| Composition 133 | 19 | 0.8 | >10 | 9.9 |
| Composition 134 | 17 | 1.5 | >10 | 10.0 |
| Composition 135 | 19 | 4.5 | >10 | 10.6 |
| Composition 136 | 18 | 5.2 | Impossible to mold | — |

As is apparent from Table 24, when the viscosity ratio η4/η3 was more than 5, it was difficult to mold the composition due to the deterioration of the composition within the molding machine. On the other hand, when the viscosity ratio was not more than 5, the compositions could be recycled more than ten times for molding. For this reason, the upper limit of the viscosity ratio is 5 from the viewpoint of moldability. When the viscosity ratio was less than 0.3, the composition could be recycled more than 10 times. In this case, however, the mechanical strength of the molded body was about half of that of the molded bodies from the compositions having a viscosity ratio of not less than 0.3, that is, the mechanical strength of the extrudate was lowered. For this reason, the viscosity ratio should not be less than 0.3 from the viewpoint of ensuring the mechanical strength.

The same results as obtained in Examples 8, 9 and 10 are obtained also in the cases where PPS, PEN and the like are used as the resin component. Further, the same results can be obtained also in the cases where rare-earth magnet powders obtained in Examples 8 and 10 are used as the magnet powder.

The influence of the resin on extrusion will now be described as Example 11.

1 wt % of chelating agent 10 was added and mixed with an Nd-Fe-B-based magnetic powder (MQP-B powder manufactured by GM) and various resin components specified in Table 25 so that the volume percent of the magnetic powder was 75 vol %. The mixtures were kneaded and placed in an extruder to carry out a molding experiment.

In Table 25, the volume ratio of resins in the resin component is the proportion of each resin in the resin component when the volume ratio of the whole resin component is taken as 100. For the molding experiment, the magnets were in the form of a pipe having an outer diameter of 18 mm and an inner diameter of 16 mm, and the length of the cooling section was 20 mm.

The experimental results are given in Table 26. In Table 26, "Temp. of cooling section at which composition could have been successfully extruded" is the temperature range of the cooling section in which in the molding experiment, the molded body could maintain its shape and extruded through a die while maintaining the shape. The broader the temperature range, the better the extrudability. The extrusion rate indicated in Table 26 is the highest attainable extrusion rate. The extrudability represents the easiness of setting moldable conditions and the molding stability.

TABLE 25

| | Resin Component | Ratio of resins in resin component (vol %) |
|---|---|---|
| Resin 1 | Nylon 12/Nylon 11 | 50/50 |
| Resin 2 | Nylon 12/Nylon 6 | 50/50 |
| Resin 3 | Nylon 12/Nylon 11/Nylon 6 | 40/30/30 |
| Resin 4 | Nylon 12/Nylon 6–12 (Copolymer) | 50/50 |
| Resin 5 | PPS/Liquid Crystalline polymer | 50/50 |
| Resin 6 | Nylon 12 | 100 |
| Resin 7 | Nylon 6 | 100 |
| Resin 8 | PPS | 100 |

TABLE 26

| Molding | Resin | Temp. of cooling section at which composition could be successfully extruded (°C.) | Extrusion rate (mm/sec) | Extrudability |
|---|---|---|---|---|
| 1 | Resin 1 | 170-175 | 5.0 | ○ |
| 2 | Resin 2 | 200–215 | 8.5 | ○ |
| 3 | Resin 3 | 200–218 | 8.7 | ○ |
| 4 | Resin 4 | 148–160 | 8.0 | ○ |
| 5 | Resin 5 | 280–288 | 5.0 | ○ |
| 6 | Resin 6 | 160–162 | 3.0 | Δ |
| 7 | Resin 7 | 207–208 | 2.6 | Δ |
| 8 | Resin 8 | 281 | 1.8 | Δ |

Note) ○: Good extrudability
Δ: Poor extrudability
X: Impossible to extrude

As is apparent from Table 26, for all the moldings 6, 7 and 8 wherein only one resin was used, the moldable temperature range was as small as 2° C. or below, so that it was difficult to extrude the composition and, at the same time, to increase the extrusion rate. By contrast, when two or more resins were used, the moldable temperature range was increased to about 10° C., which facilitated molding and contributed to improvement in extrusion rate.

The above results show that the use of two or more resins having different melting points as the resin component in the magnet composition for extrusion can contribute to improvement in moldability and extrusion rate.

Then, the influence of the difference in melting point between resins mixed was investigated.

Alloying ingredients were weight and melted so as to give an alloy composition, $$Sm(Co_{0.672}Fe_{0.22}Cu_{0.08}Zr_{0.028})8.35,$$

and the melt was cast into an alloy. The alloy was then heat-treated and pulverized to prepare a magnetic powder having an average particle diameter of about 20 μm. The magnetic powder, a resin component specified in Table 27, and a plasticizer were weighed and mixed together so that the volume percent of the magnetic powder was 70%. The mixtures were kneaded to prepare magnet compositions. The melting points of various resins used and the difference in melting point between the resins are given in Table 27. For all the compositions, the resins were mixed so that PPS or nylon 12 occupied 70% of the whole resin component.

TABLE 27

| | Resin component Numerical value in lower line: m.p. of each resin (°C.) | Difference in m.p. (°C.) |
|---|---|---|
| Resin 9 | PPS/Nylon 66 (290) (260) | 30 |
| Resin 10 | PPS/Polyethernitrile(PEN) (290) (340) | 50 |
| Resin 11 | PPS/Nylon 6 (290) (220) | 70 |
| Resin 12 | Nylon 12/Nylon 6 (180) (220) | 40 |
| Resin 13 | Nylon 12/Nylon 6–12 (Copolymer) (180) (140) | 40 |
| Resin 14 | Nylon 12/Nylon 66 (180) (260) | 80 |

Each magnet composition comprising the resins specified in Table 27 was placed in an extruder to carry out an extrusion experiment. The results are given in Table 28. In the extrusion experiment, the compositions were extruded into magnets in an arc form of 5.0R×4.0r×115°, and the length of the cooling section was 15 mm.

TABLE 28

| Molding | Resin | Temp. of cooling section at which composition could be successfully extruded (°C.) | Extrusion rate (mm/sec) | Extrudability |
|---|---|---|---|---|
| 9 | Resin 9 | 275–287 | 6.8 | ○ |
| 10 | Resin 10 | 285–293 | 5.8 | ○ |
| 11 | Resin 11 | 272–273 | 2.1 | Δ |
| 12 | Resin 12 | 170–184 | 9.8 | ○ |
| 13 | Resin 13 | 147–164 | 10.2 | ○ |
| 14 | Resin 14 | 179–160 | 2.3 | Δ |

Note) ○: Good extrudability
Δ: Poor extrudability
X: Impossible to extrude

As is apparent from Table 28, when the resins 9, 10, 12 and 13 having a melting point difference of not more than 50° C. were used for the molding experiment, the moldable temperature range was about 10° C., so that the composition containing these resins could be easily extruded even at a high speed. On the other hand, for moldings 10 and 14 using resin components having a melting point difference of more than 50° C., although the extrusion was possible, the compositions containing these resin components had a narrow moldable temperature range and could not be extruded at a high speed but only at a low extrusion rate. Further, it was difficult to adjust the molding conditions, and even after completing the adjustment of the molding conditions, the extrusion could not be stably carried out, which renders the mass production of the extrude difficult.

From the above results, it is apparent that the difference in melting point between the resins incorporated is preferably not more than 50° C.

Then, the influence of the melting point of the resins used was investigated.

An Nd-Fe-B-based magnetic powder (MQP-B powder manufactured by GM), a resin component and an antioxidant were weighed so that the volume percent of the magnetic powder was 80 vol %. They were mixed and kneaded together to prepare magnet compositions. In this case, the resin component comprised a mixture of 60% of a nylon 6–12 copolymer (nylon 6:25 ) having a melting point of 150° C. with 40% of nylon 6–12 copolymers, having various melting points, prepared by varying the ratio of monomers as indicated in Table 5. These magnet compositions were placed in an extruder and extruded into a pipe having an outer diameter of 20 mm and an inner diameter of 17 mm. The variation (scattering) in dimension of the magnets thus obtained was ±2/100 mm in terms of outer diameter. Each magnet was cut into a length of 10 mm and allowed to stand in a thermostatic chamber kept at 120° C. for 500 hours, and the variation in outer diameter of the pipes after standing was measured. The results are given in Table 29.

TABLE 29

| Molding | m.p. (°C.) of copolymer mixed | Variation in outer diameter after standing (mm) |
|---|---|---|
| Magnet 12 | 100 | ±20/100 |
| Magnet 13 | 110 | ±10/100 |
| Magnet 14 | 120 | ±5/100 |
| Magnet 15 | 135 | ±3/100 |

As is apparent from Table 29, as the melting point of the copolymer mixed lowers, the variation in dimension of the magnets after standing at 120° C. for 500 hours increases. This is because in the case of the extrudate with a resin having a low melting point being incorporated therein, the low-melting resin component melts upon standing at an elevated temperature, resulting in deformation of the extrudate which increases the variation in dimension. Properties required of magnet are generally 120° C. for heat resistance and about ±5/100 mm for dimensional accuracy, and when a resin having a melting point below 120° C. was incorporated, it was difficult to satisfy the dimensional accuracy requirement.

From the above results, the melting point of the resin to be incorporated is preferably 120° C. or above.

Further, the influence of the molecular weight of the resin used was investigated.

An Sm-Co-based magnetic powder, a resin component, wherein 50 vol % of the whole resin component is occupied by nylon 12 having a number average molecular weight of 12000, and a plasticizer were mixed together so that the volume percent of the magnetic powder was 72.5 vol %. The mixture was kneaded to prepare magnet compositions. In this case, nylon 6 having various molecular weights specified in Table 6 was used as the balance 50% of the resin component. These magnet compositions were placed in an extruder to investigate the extrudability of the compositions. The results are given in Table 30. The magnet as the extrudate was in the form of a pipe having an outer diameter of 30 mm and an inner diameter of 27 mm. In Table 30, "Continuous molding time" represents the period of time for which molding could be continued without adjustment after setting of the molding conditions at the time of start of the extrusion.

TABLE 30

| Molding | Molecular weight of nylon 6 (number average) | Continuous molding time (hr) | Extrusion rate (mm/sec) |
|---|---|---|---|
| 15 | 12000 | >8 | 6.2 ± 0.2 |
| 16 | 20000 | >8 | 5.0 ± 0.3 |
| 17 | 35000 | >8 | 5.7 ± 0.3 |

TABLE 30-continued

| Molding | Molecular weight of nylon 6 (number average) | Continuous molding time (hr) | Extrusion rate (mm/sec) |
|---|---|---|---|
| 18 | 55000 | 8 | 5.3 ± 0.5 |
| 13 | 65000 | 2.5 | 4.0 ± 1.0 |

As is apparent from Table 30, when the molecular weight of nylon 6 was not higher than 55000, it is possible to continue the extrusion for at least 8 hours which is a measure of the continuous molding time which permits mass production of the extrudate, whereas when the molecular weight of nylon 6 was 65000, the extrusion could not be continued for 8 hours or longer. The reason for this is considered as follows. When resins having different molecular weights are mixed together, the dispersion of the resin component by kneading is unsatisfactory, which lowers the homogeneity of the magnet composition. This gives rise to a variation in extrusion rate at the time of extrusion, which leads to a change in molding conditions, causing stop of the delivery of the extrudate during extrusion. This makes it impossible to extrude the composition in a continuous manner.

The above results show that the difference in molecular weight between the resins mixed is preferably such that the average molecular weight of the resins except for the resin having the lowest average molecular weight is not more than 5 times the average molecular weight of the resin having the lowest average molecular weight.

The extrudate as described above is prepared by extrusion wherein the composition is solidifed by cooling in a die as described in Example 4. The preparation of bonded magnets by the conventional extrusion of a resin was carried out as a comparative example. The results were as follows.

An Nd-Fe-B-based magnet powder (MQP-B powder manufactured by GM), resin 4 and an antioxidant were weighed, mixed and kneaded together so that the volume percent of the magnetic powder was 70 vol %, thereby preparing a magnet composition. The magnet composition was fed in an extruder and then extruded. In this case, the composition was formed in a die into a desired shape which, as such, was delivered without cooling in the cooling section located at the forward end of the die. The extrudate was introduced into a sizing die while taking off the extrudate by means of a take-off device provided forward of the extruder, where the extrudate was cooled while finally regulating the shape. The aimed dimension of the magnet to be produced as the final extrudate was 18 mm in outer diameter and 16 mm in inner diameter.

The extrudate, however, was unfavorably broken in the course of introduction thereof from the die into the sizing die. Even when the final extrudate was casually obtained, it was immediately broken, so that molding could not be stably carried out.

An Sm-Co-based magnet powder (average particle diameter: about 20 $\mu$m), resin 12 and a plasticizer were weighed, mixed and kneaded together so that the volume percent of the magnetic powder was 75 vol %, thereby preparing a magnet composition. The magnet composition was fed in an extruder and then extruded. In this case, the composition was formed in a die into a desired shape which, as such, was delivered without cooling in the cooling section located at the forward end of the die. The extrudate was introduced into a sizing die while taking off the extrudate by means of a take-off device provided forward of the extruder, where the extrudate was cooled while finally regulating the shape. The aimed magnet to be produced as the final extrudate was in the form of a tile of 5.0R×4.0r×115°.

The extrudate, however, was unfavorably broken in the course of introduction thereof from the die into the sizing die. Even when the final extrudate was casually obtained, it was immediately broken, so that molding could not be stably carried out.

An Sm-Co-based magnetic powder (average particle diameter: about 20 $\mu$m), the resin used in the molding 15 and a plasticizer were weighed, mixed and kneaded together so that the volume percent of the magnetic powder was 72.5 vol %, thereby preparing a magnet composition. The magnet composition was fed in an extruder and then extruded. In this case, the composition was formed in a die into a desired shape which, as such, was delivered without cooling in the cooling section located at the forward end of the die. The extrudate was introduced into a sizing die while taking off the extrudate by means of a take-off device provided forward of the extruder, where the extrudate was cooled while finally regulating the shape. The aimed magnet to be produced as the final extrudate was in the form of a pipe of 30 mm in outer diameter and 27 mm in inner diameter.

The extrudate, however, was unfavorably broken in the course of introduction thereof from the die into the sizing die. Even when the final extrudate was casually obtained, it was immediately broken, so that molding could not be stably carried out.

Then, warm compression molding was investigated as a method for producing a rare-earth bonded magnet. The results were as follows.

An Nd-Fe-B-based magnetic powder, a polyamide resin, chelating agent 9 and antioxidant D were weighed and mixed together so that the volume percent of the magnetic powder was 78.0 vol %. The mixture was kneaded by means of a KCK kneader to prepare a magnet composition. This composition was placed in a mold heated at 220° C., a temperature above the melting temperature of the resin, and subjected to warm compression molding at a molding pressure of 3 tons/cm$^2$. Thus, a ring magnet having an outer diameter of 20 mm, an inner diameter of 17 mm and a length of 20 mm was prepared. This magnet was designated as a magnet 16.

For comparison, the above mixture was molded without kneading into a magnet. The resultant magnet was designated as magnet 17. Further, a bonded magnet was prepared by the conventional compression molding. The resultant magnet was designated as magnet 18. For the magnet 18, 1.5 wt % of an epoxy resin was used as the resin component. These magnets were evaluated for magnetic properties, density of the molded body, variation in density within the molded body and corrosion resistance. The results are given in Table 31. In Table 31, the variation in density within the molded body is the variation in density determined by slicing the molded body to provide 1 mm-thick slice samples and measuring the density of the slice samples. The corrosion resistance represents the number of non-defectives when each 10 magnets have been allowed to stand at 60° C. and 95% of relative humidity for 500 hr.

TABLE 31

| Magnet | Br (kG) | iHc (kOe) | (BH) max | ρ (g/cm$^3$) | Corrosion resistance |
|---|---|---|---|---|---|
| Magnet 16 | 7.23 | 9.67 | 10.0 | 6.12 ± 0.01 | 10 |
| Magnet 17 | 7.08 | 9.73 | 9.7 | 6.05 ± 0.1 | 8 |
| Magnet 18 | 7.32 | 9.69 | 10.0 | 6.10 ± 0.1 | 0 |

As is apparent from Table 31, when the composition obtained by kneading was molded by warm compression molding, the variation in density was small and, at the same time, the corrosion resistance was good. On the other hand, for the molded body prepared from the mixture without kneading and the molded body prepared by the conventional molding method had a large variation in density and high corrosion resistance. This is because in the case of the conventional magnets, many vacancies are present within the magnets, resulting in deteriorated corrosion resistance and increased variation in density. Further, in the case of the molded body prepared from a mixture without kneading, the dispersion of the magnetic powder and the like is so poor that the density is lowered and the corrosion resistance is deteriorated. By contrast, for the magnet 16, the additive is well dispersed, and the magnet prepared by molding has a density close to the theoretical density and, hence, has high corrosion resistance.

Then, an Sm-Co-based magnetic powder, PPS and a chelating agent 9, an antioxidant D were weighed and mixed together so that the volume percent of the magnetic powder was 78.0%. The mixture was kneaded by means of a KCK kneader to prepare a magnet composition. This composition was placed in a mold heated at 300° C., a temperature above the melting temperature of the resin, and subjected to warm compression molding under a magnetic field of 15 kOe for alignment and a molding pressure of 2 tons/cm$^2$. Thus, a ring magnet having an outer diameter of 20 mm, an inner diameter of 17 mm and a length of 20 mm was prepared. This magnet was designated as a magnet 19.

For comparison, the above mixture was molded without kneading into a magnet. The resultant magnet was designated as magnet 20. Further, a bonded magnet was prepared by the conventional compression molding. The resultant magnet was designated as magnet 21. For the magnet 21, 1.5 wt % of an epoxy resin was used as the resin component. These magnets were evaluated for magnetic properties, density of the molded body, variation in density within the molded body and corrosion resistance. The results are given in Table 32. In Table 32, the variation in density within the molded body is the variation in density determined by slicing the molded body to provide 1 mm-thick slice samples and measuring the density of the slice samples.

TABLE 32

| Magnet | Br (kG) | iHc (kOe) | (BH) max | ρ (g/cm$^3$) |
|---|---|---|---|---|
| Magnet 19 | 8.12 | 10.59 | 15.1 | 7.10 ± 0.01 |
| Magnet 20 | 8.00 | 10.54 | 14.6 | 7.05 ± 0.1 |
| Magnet 21 | 8.11 | 10.56 | 15.0 | 7.10 ± 0.1 |

As is apparent from Table 32, when the composition obtained by kneading was molded by warm compression molding, the variation in density value was small. On the other hand, for the molded body prepared from the mixture without kneading and the molded body prepared by the conventional molding method had a large variation in density. This is because in the case of the conventional magnets, many vacancies are present within the magnets, resulting in increased variation in density. Further, in the case of the molded body prepared from a mixture without kneading, the dispersion of the magnetic powder and the like is so poor that a variation in density value occurs. By contrast, for the magnet 16, the additive is well dispersed, and the magnet prepared by molding has a density close to the theoretical density and, hence, has a high density.

Industrial Applicability

As described above, the rare-earth bonded magnet composition and the process for producing the same according to the present invention enables rare-earth magnets having high performance and high corrosion resistance to be produced with a high productivity. Further, the rare-earth bonded magnets according to the present invention are suitable for use in automobiles and equipment for OA (office automation).

We claim:

1. A rare-earth bonded magnet composition for extrusion, comprising a rare-earth magnetic powder and a polyamide resin containing an additive, said composition having a viscosity $\eta 1$, as measured in a molten state before charging into an extruder, of 5 kpoise $\leqq \eta 1 \leqq$ 500 kpoise at a shear rate: 25 $sec^{-1}$ and a viscosity $\eta 2$, as measured upon delivery from the extruder, satisfying a requirement represented by the following formula $$0.3 \leqq \eta 2/\eta 1 \leqq 10.$$

2. A rare-earth bonded magnet composition according to claim 1, wherein the additive is a lubricant.

3. A rare-earth bonded magnet composition according to claim 1 comprising an antioxidant.

4. A rare-earth bonded magnet composition according to claim 3, wherein the antioxidant is a hydrazine antioxidant.

5. A rare-earth bonded magnet comprising the composition according to claim 1.

6. A process for producing a rare-earth bonded magnet, comprising the steps of:

(a) preparing the rare-earth bonded magnet composition of claim 1 by mixing the rare-earth magnetic powder, the polyamide resin and an antioxidant to obtain a mixture thereof; and milling or kneading the thus obtained mixture and heating to place the mixture into a fluidized state thereby to obtain the rare-earth bonded magnet composition; and (b) molding the thus obtained composition in fluidized state to obtain a rare-earth bonded magnet.

7. A rare-earth bonded magnet composition for injection molding, comprising a rare-earth magnetic powder and a polyamide resin containing an additive, said composition having a viscosity $\eta 3$, as measured in a molten state before charging into an injection molding machine, of $$1 \text{ kpoise} \leqq \eta 3 \leqq 100 \text{ kpoise at a shear rate: } 1000 \text{ sec-1}$$

and a viscosity $\eta 4$, as measured upon delivery from the injection molding machine, satisfying a requirement represented by the following formula $$0.3 \leqq \eta 4/\eta 3 \leqq 5.$$

8. A rare-earth bonded magnet composition according to claim 7, wherein the additive is a lubricant.

9. A rare-earth bonded magnet composition according to claim 7 comprising an antioxidant.

10. A rare-earth bonded magnet composition according to claim 9, wherein the antioxidant is a hydrazine antioxidant.

11. A rare-earth bonded magnet comprising the composition according to claim 7.

12. A process for producing a rare-earth bonded magnet comprising the steps of:

(a) preparing the rare-earth bonded magnet composition of claim 7 by mixing the rare-earth magnetic powder, the polyamide resin and an antioxidant to obtain a mixture thereof; and milling or kneading the thus obtained mixture and heating to place the mixture into a fluidized state thereby to obtain the rare-earth bonded magnet composition; and (b) molding the thus obtained composition in fluidized state to obtain a rare-earth bonded magnet.

* * * * *